United States Patent [19]

Steckis

[11] Patent Number: 4,796,388

[45] Date of Patent: Jan. 10, 1989

[54] DEFLASHING APPARATUS

[76] Inventor: Al Steckis, 19 N. Ridge Dr., Coram, N.Y. 11727

[21] Appl. No.: 71,365

[22] Filed: Jul. 9, 1987

[51] Int. Cl.[4] ..... B24B 31/02

[52] U.S. Cl. ..... 51/164.1; 51/314; 51/22; 241/65

[58] Field of Search ..... 51/164.1, 163.1, 313, 51/314, 422, 22, 17; 241/65, 66

[56] References Cited

U.S. PATENT DOCUMENTS

| | | | |
|---|---|---|---|
| Re. 27,412 | 6/1972 | Olson et al. | 51/313 X |
| 2,509,041 | 5/1950 | Lubenow | 51/164.1 |
| 2,613,036 | 10/1952 | Robinson | 51/164.1 X |
| 2,713,474 | 7/1955 | Read | 241/65 |
| 2,809,473 | 10/1957 | Heaphy | 51/164.1 |
| 3,134,203 | 5/1964 | Roberts | 51/164.1 |
| 3,172,546 | 3/1965 | Schreiner | 241/23 |
| 3,333,367 | 8/1967 | Salvaire | 51/164.1 |
| 3,363,846 | 1/1968 | Eck | 241/15 |
| 3,504,124 | 3/1970 | Kittredge et al. | 51/314 |

FOREIGN PATENT DOCUMENTS

| | | | |
|---|---|---|---|
| 2201617 | 7/1973 | Fed. Rep. of Germany | 241/65 |

*Primary Examiner*—Robert P. Olszewski
*Assistant Examiner*—Shirish Desai
*Attorney, Agent, or Firm*—Jules E. Goldberg

[57] ABSTRACT

An apparatus for deflashing of elastomeric elements comprising: (a) a tumbling barrel having a closable opening for introducing and withdrawal of elastomeric elements and deflashing media to the interior of the barrel; (b) a refrigeration chamber sized for receiving the barrel therein, having an access opening for providing access to a barrel located therein, having mechanism for mounting the barrel therein, and having apparatus for lowering the temperature of the interior of the chamber; and (c) mechanism for imparting motion to the barrel mounted within the chamber to achieve impacting movement to the barrel contents. The apparatus avoids the high costs and dangers of the complicated prior art cryogenic devices and is excellently suited for smaller molders.

22 Claims, 2 Drawing Sheets

DEFLASHING APPARATUS

BACKGROUND OF THE INVENTION

1. Field of the Invention

This invention relates to an apparatus and method for the removal of flashing from elastomeric elements after they have been molded. More particularly, it is directed to a refrigerating and tumbling device for achieving deflashing of such elements.

2. Description of the Prior Art

The manufacture of molded elements from elastomeric materials, such as, synthetic and organic rubbers, as well as silicone rubbers, is well known. In the manufacture of such materials, a thin extraneous membrane (called "flashing") of the elastomer forms about the edges of the main body of the molded part. In the finishing of the molded part, it is necessary that the flashing be removed.

In the past, flashing was removed by manual methods which, of course, proved to be extremely slow and economically unfeasible. Cryogenic deflashing methods have been developed which utilize the principle that the very thin flashing membranes freeze much more quickly than the body of the molded element. When frozen, the flashing becomes extremely brittle, and when impacted with other molded parts or appropriate media, e.g., sand or other particulate material, the frozen, brittle flashing membrane breaks cleanly at the edge of the molded element. This results in a smooth surface, free from the undesirable flashing membrane.

The devices and methods used heretofore for cryogenic deflashing of such elements have relied on quick freezing of the elements using extremely cold temperatures, i.e., temperatures in the range from −32° C. to −150° F. For this purpose, the art has used solid or liquefied carbon dioxide or liquid nitrogen. Typically, the molded parts to be deflashed are immersed in the solid or liquid carbon dioxide or liquid nitrogen in a vessel which contains, if desired, an appropriate deflashing media. The vessel is rotated or vibrated so as to cause impact between the parts and/or media. The flashing membrane freezes to brittleness and easily breaks away upon impact.

Because of the nature of the cryogenic materials, e.g., liquid nitrogen, liquid carbon dioxide, and solid carbon dioxide, the devices for use with such materials are necessarily relatively complicated and expensive. Because such materials are or become gaseous, they generally result in pressure build-ups so that the apparatuses must be sufficiently structurally strong to withstand the higher pressures resulting from these materials. In addition, substantial insulating must be used with the devices because of the "quick freeze" aspect of the cryogenic materials.

Because of the extremely low temperatures accompanying their use as well as the pressure build-up, there is also a safety problem and the devices must be equipped with appropriate safety mechanisms to avoid accidents. Also, of course, appropriate storage tanks must be provided with such devices to provide for holding the cryogenic materials during their use.

All of this contributes to the increased complexity and costs of these prior art devices. In addition, the use of the cryogenic materials, in and of itself, provides a storage and handling problem for the user. Normally, smaller elastomer finishing operations do not have or cannot afford to maintain the expensive facilities needed to store significant amounts of the cryogenic materials on site. As a result, the cryogenic materials must be delivered shortly before their use. This can cause supply problems if the cryogenic materials cannot be provided at the time necessary for their use in the deflashing apparatus. Of course, the cryogenic materials themselves are relatively expensive.

An additional problem with the prior devices is that their use is accompanied by an extremely high noise level, particularly, when a number of the machines are being used at the same time. Usually, workers in the area are required to wear ear protection because of the intensity of the noise. In addition, these machines generate a substantial amount of dust. Each of these disadvantages results in the machines normally being kept in a separate room in order to isolate both the noise and the dust from other areas of the workplace.

Also, because of the relative complexity of the machines and the necessity for having a source of liquid nitrogen close at hand, as well as the pressures which are generated in the devices, the machines are normally fixed in place. Thus, they are not easily movable from one area to another.

SUMMARY OF THE INVENTION

I have discovered a device for the removal of the thin flashing membrane resulting from the molding of elastomeric elements which avoids the costly apparatus, operations and dangers of the prior art cryogenic devices. It further avoids the need to have a constant supply of liquid nitrogen or liquid or solid carbon dioxide near at hand and is superbly suited for the smaller molder. Moreover, the device of the present invention represents a substantial cost saving as compared to the complicated cryogenic devices presently used.

In particular, the apparatus of the present invention comprises a tumbling barrel which has a closable opening so that molded elastomeric elements and, if desired, deflashing media, can be introduced to the barrel. The device further comprises a refrigeration chamber which is larger than the barrel so that the barrel can be placed therein. The refrigeration chamber has an appropriate cooling means for lowering the temperature of the interior of the chamber and further has means for imparting an impacting movement to elements to be deflashed which are placed within the barrel. As used herein, the expression "impacting movement" means motion which is sufficient to cause the elements which are to be deflashed to collide with each other and/or with media within the barrel with sufficient force to effect deflashing.

This "impacting movement" may be achieved by having means for rotatably mounting the tumbling barrel within the chamber with appropriate drive means for rotating the barrel when it is so mounted. Alternatively, the apparatus can have means for vibrating the barrel while it is in the chamber or rotating the barrel through reciprocal rotation cycles wherein the barrel is rotated in any given cycle less than 360 degrees.

The present invention also comprises a method for deflashing elastomeric elements by introducing the elastomeric elements into a tumbling barrel, movably mounting the tumbling barrel within a refrigeration chamber, the interior of which has been cooled to the desired deflashing temperature, and moving the barrel within said chamber toimpart an impacting movement to the contents of the barrel.

With the present invention, when the refrigeration chamber is insulated, substantial reduction in the noise produced when operating the apparatus is effected. In addition, because of the fact that the tumbling barrel is within an enclosed chamber, namely, the refrigeration chamber, there is a substantial reduction in the dust production in the room in which the operation is being carried out.

Finally, because of the apparatus of the present invention need only be plugged into an appropriate electrical outlet and does not need accompanying piping and/or pressurized connections to gas sources, the apparatus is easily movable from one location to another within a working site. This greatly enhances the flexibility of the apparatus as compared to prior art devices.

DESCRIPTION OF THE PREFERRED EMBODIMENT

Figure 1:
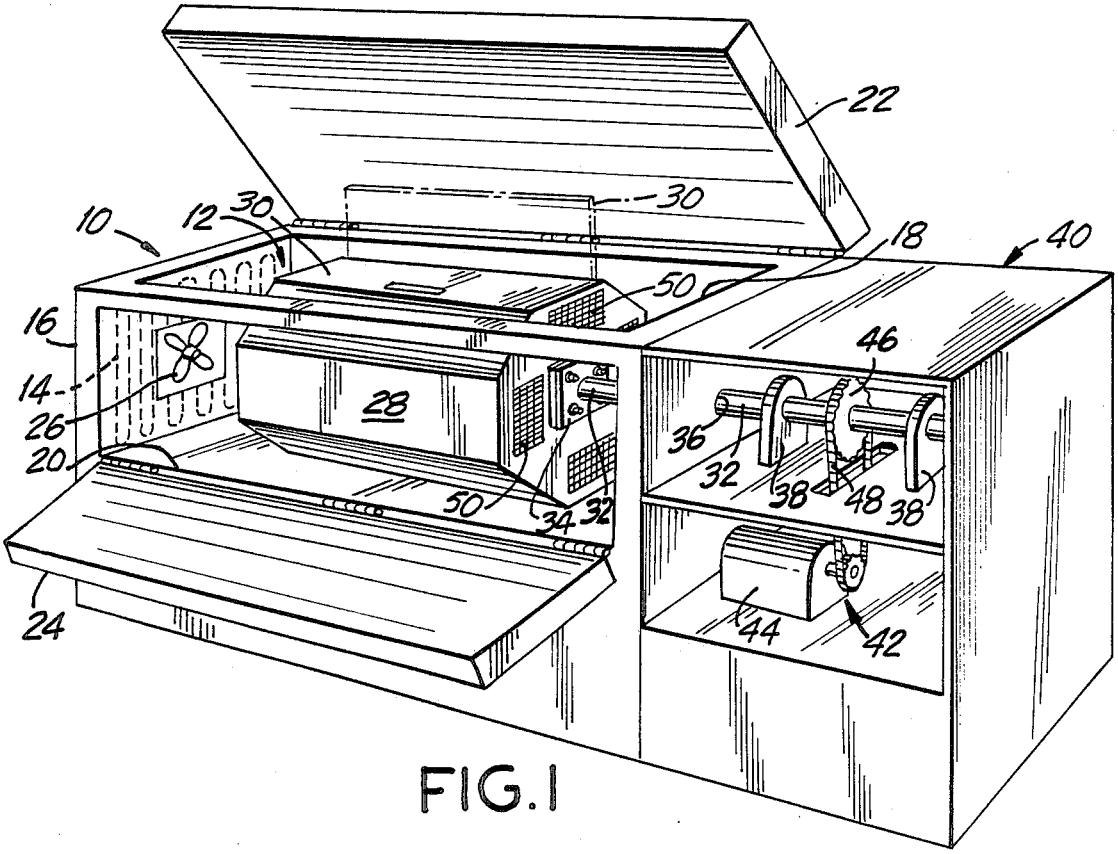
FIG. 1 is a perspective view of an apparatus in accordance with the present invention.

FIG. 1 shows an apparatus in accordance with the present invention, designated generally as 10, comprises a first chamber 12, having refrigeration means for cooling the interior of the chamber. In the drawing, the refrigeration means are shown as cooling coils within the walls constituting the chamber. Such refrigeration systems are known and normally comprise refrigeration coils connected to an appropriate compressor/motor arrangement (not shown) and a refrigerant gas system, e.g., freon, and the like. The walls 16 forming chamber 12 contain insulation sufficient to assist in temperature control in the interior of the chamber and for noise abatement.

Chamber 12, as shown in the drawing, also has two apertures 18 and 20 with appropriate closures 22 and 24. These closures 22 and 24 are doors which would have appropriate locking means (not shown) and are attached in a conventional manner by hinges. The openings allow access to the interior of the refrigeration chamber. Two openings may be provided for convenience, although, of course, a single opening would be sufficient. The doors are also appropriately insulated in order to maintain the desired low temperature of the interior of the chamber.

If desired, a circulating means may be provided for the interior of the chamber shown as fan 26 for purposes of circulating the cooled atmosphere within the chamber to assist in uniform cooling. The refrigerating means should be capable of reducing the interior of chamber 12 to a temperature sufficiently low to effect freezing of the flashing membrane so that it will be removed during the operation. The desirable deflashing temperature depends on the particular elastomer being treated. A preferred temperature range is from about −32° to −180° F., most preferably, about −32° to about −150° F. Moreover, the refrigerating mechanism desirably possesses control means, conventional in the art, so as to be able to maintain the temperature within ±10° F. of the desired temperature for a given deflashing operation. Thus, depending upon the particular elastomeric material being deflashed, a temperature within the above-specified range with the variation of ±10° F. would normally be used. One of the distinct advantages of the present system utilizing conventional refrigeration means is the improved temperature control that can be attained, as compared to, for example, liquid nitrogen systems.

Mounted in the interior of chamber 12 is a tumbling barrel 28. The tumbling barrel shown is hexagonal in shape, although other conventional shapes may be used. Typically, such a tumbling barrel may have a length of approximately 30 inches with each side being approximately 14 inches wide. Of course, larger or smaller tumbling barrels may be utilized depending upon the amount of elastomeric elements to be treated as well as the amount of deflashing media to be used. One of the sides 30 of barrel 28 constitutes a door with hinges (not shown) to provide access to the interior of barrel 28. This side may be opened for introducing elastomeric components and media to the interior of barrel 28 and then secured in the shut position for the tumbling operation.

Barrel 28 has extending therefrom a shaft 32 which is securely mounted to the side of barrel 28 via bolted plate 34. Shaft 32 is attached to the barrel at its axis of rotation and extends therefrom through circular aperture 36 in the side wall of refrigerating chamber 12. Shaft 32 and aperture 36 are in an isulatingly sealed relationship to avoid interference with the maintenance of the decreased temperature within chamber 12. Also, however, shaft 32 is able to rotate in aperture 36.

Shaft 32 is supported exterior of chamber 12 by supporting bearings 38 as shown. In the drawing, the bearings are attached to a supporting chassis indicated generally at 40. The entire combination of supporting bearings 38 and shaft 32 are sufficiently strong such as to support in a rotatable manner, tumbling barrel 28 within the interior of chamber 12.

Shown generally at 42 is a drive means composed of a motor 44 having a belt or drive chain 48 attached to the motor drive shaft which is, in turn, connected to a rotary gear 46, mounted on shaft 32. Drive means 42 has appropriate control means, conventional in the art for activting the motor as well as controlling the speed of rotation of tumbling barrel 28. Preferably, drive means 42 is sufficient to rotate tumbling barrel 28 at speeds of up to about 200 rpm. The desired speed of rotation will necessarily depend on the particular elements which are being deflashed.

Alternatively, the drive means can be such so that tumbling barrel does not rotate through a full 360 degree cycle. Thus, drive means 42 can be adapted to effect reciprocal rotary movement of the tumbling barrel through rotations of less than 360 degrees. In essence, this means that the barrel would rotate a given number of degrees in one direction and then rotate back through that same number of degrees in the opposite direction.

The time period for tumbling depends on the particular elements to be deflashed. Normally, the tumbling will be carried out for a period from about 15 minutes to 4 hours.

Tumbling barrel 28 may also, if desired, have apertures 50 in the side walls thereof providing access of the cooled atmosphere within chamber 12 into the interior of the tumbling barrel. These apertures would be suitably screened so as to prevent loss of any tumbling media or the elements during operation of the apparatus. This aids in cooling of the interior of the tumbling barrel. As is clear, however, no special gas or atmosphere is maintained within the barrel or chamber. Thus, only atmospheric air is present. Consequently, there is no need for the chamber walls, tumbling barrel or other elements of the invention (except, of course, for the internal aspects of the sealed refrigeration system) to be especially designed or structured so as to withstand pressure other than normal atmospheric pressure. In this manner, the cooling mechanism of the present invention is indirect in that the actual refrigerant does not directly contact the elastomer elements.

As shown in FIG. 1, the drive means 42 as well as the shaft 32 are placed exterior of refrigeration chamber 12. It is possible, of course, to locate the entire drive means including the shaft supports 38 within chamber 12. However, the embodiment shown is desirable from the standpoint that the drive mechanism does not interfere with the refrigeration of the interior of chamber 12.

In operation, the elements to be deflashed and any deflashing media therefor are introduced into tumbling drum 28 which is rotatably mounted within chamber 12. It should be noted that tumbling barrel 28 can be removably mounted in chamber 12 so that tumbling barrels of different sizes and/or shapes may be used as desired.

Figure 2:
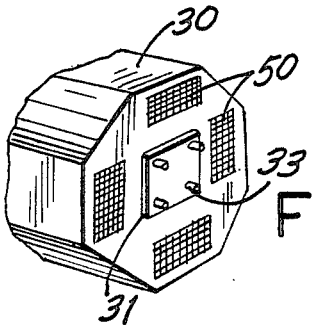
FIG. 2 is a partial perspective of a detail of the apparatus of FIG. 1.

A variety of mechanisms may be used for removably mounting tumbling barrel 28 within chamber 12. For example, a mounting plate could be secured to the side of tumbling barrel 28 and shaft 32 can have a flange corresponding to the mounting plate attached to its end. The mounting plate and mounting flange are simply bolted to one another to secure the tumbling barrel to the shaft. To replace the tumbling barrel with another, the bolts are simply undone and a new tumbling barrel having its own mounting plate secured thereto can be introduced to and secured in the chamber. The mounting plate on the barrel is shown in greater detail in FIG. 2. Plate 31 is secured to the side of barrel 30 by means not shown. Extending from plate 31 are bolts 33 which can be threaded. Plate 34 (FIG. 1) which is securing the end of shaft 32 can have holes therein in registration with bolts 33. When the two plates 31 and 34 are married, they can be secured to one another through nuts. (not shown).

The removability of tumbling barrel 28 is advantageous since additional tumbling barrels can be maintained in a refrigerated state exterior of chamber 12, i.e., in a separate conventional refrigeration unit. Also, the deflashing media can be kept in a refrigerated state. In use, a precooled tumbling barrel with its precooled ingredients can then be introduced to chamber 12, thus reducing the amount of time to bring the contents of the tumbling barrel down to the desired temperature. This procedure is advantageous in reducing the overall deflashing time, so that while one barrel is being utilized within apparatus 10, other tumbling barrels with their ingredients are being cooled.

Figure 3:
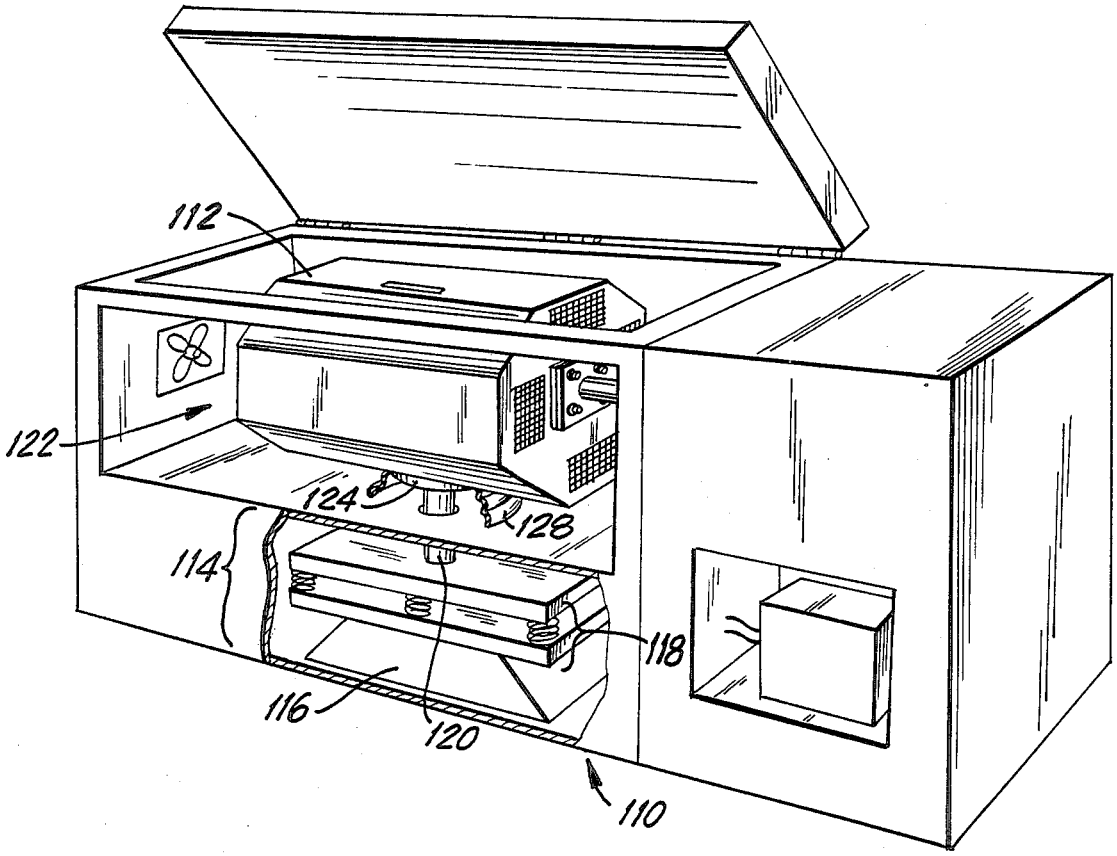
FIG. 3 is an exploded perspective view of another embodiment of the invention.

FIG. 3 shows yet another embodiment of the present invention wherein rather than imparting rotary movement to the tumbling barrel, it is made to vibrate so as to place the contents of the barrel into motion. As shown in FIG. 3, this can be accomplished by having the apparatus generally shown at 110 with tumbling barrel 112 attached to vibrating means shown generally at 114. Vibrating means 114 is composed of a mechanical or electromagnetic vibrator 116 which supports a pair of plates 118 secured to each other by springs and sandwiched therebetween. Mounted on the top plate of plates 118 is a shaft 120 which protrudes through the bottom of refrigeration chamber 122. Shaft 120 is secured, preferably in a removable manner by flange 124 to the bottom of tumbling barrel 112. Insulating boot 128 is provided to cover the area where shaft 120 protrudes through the bottom wall of refrigeration chamber 122. Also shown exterior of the refrigeration chamber is the cooling means indicated as being a compressor refrigerant.

In use, the elements to be deflashed and/or media are introduced to the tumbling barrel 112, the contents cooled within the refrigeration chamber and set into motion with the vibrating means. In this connection, it is noted that it is not necessary for media to be used in every instance. Thus, depending on the nature and size of the elastomeric elements, it is possible to effect deflashing without the presence of media.

An alternative procedure is to place the media into the barrel and cool the barrel and its contents to the desired deflashing temperature. The elements are then placed into the barrel with the precooled media and subjected to impacting movement by rotation, vibration, etc., until they are completely deflashed. The elements are then removed from the barrel and the next batch of elements is subjected to the same treatment. In this manner, the media is continuously maintained at the desired temperature and the newly introduced elements cool quickly to the deflashing temperature. This procedure greatly reduces the time for deflashing.

The following example illustrates the present invention.

Using a tumbling device as shown in FIG. 1 hereof, tumbling media composed of $\frac{1}{4}$ inch thick triangular shaped stones having a side surface of approximately $\frac{3}{8}$ inch in length was placed into a tumbling barrel and the media in the tumbling barrel was cooled to $-100°$ F. This took from about 6 to 8 hours. As of this point, the tumbling unit will maintain the barrel and media temperature.

1000 pieces of a molded neoprene washer having a 1 inch outside diameter, a $\frac{1}{4}$ inch inside diameter and a thickness of $\frac{3}{4}$ inches were placed into the tumbling barrel. With the barrel closed and refrigerating chamber closed, the barrel was rotated at a speed of approximately 60 rpm for a period of from 30 to 45 minutes. The neoprene washers were then removed from the tumbler and all flashing thereon had been removed.

As shown, the apparatus of the present invention is highly advantageous in that it completely avoids the need for the refrigeration chamber to be sufficiently strong so that it can withstand the build-up of pressure within its interior. This, in turn, avoids the dangers of utilizing cryogenic materials, such as, liquid nitrogen and dry ice. The present apparatus provides both economic as well as safety advantages over prior art devices.

What is claimed is:

1. An apparatus for deflashing of elastomeric elements comprising:

(a) a tumbling barrel having a closable opening for introducing and withdrawal of elastomieric elements and deflashing media to the interior of the barrel;

(b) a refrigeration chamber sized for receiving the barrel therein, having an access opening for providing access to a barrel located therein, having means for mounting the barrel therein, means for lowering the temperature of the interior of the chamber and having additional cool air circulation means within the interior of the chamber;

(c) means for imparting motion to the barrel mounted within the chamber to achieve impacting movement to the barrel contents and (d) said barrel having aperture means providing access of the cooled atmosphere within the refrigeration chamber into the interior of the tumbling barrel.

2. An apparatus for deflashing of elastomeric elements comprising:

(a) a tumbling barrel having a closable opening for introducing and withdrawal of elastomeric elements and deflashing media to the interior of the barrel;

(b) a refrigeration chamber sized for receiving the barrel therein, having an access opening for providing access to a barrel located therein, having means for mounting the barrel therein, and having means for lowering the temperature of the interior of the chamber; and (c) means for imparting motion to the barrel mounted within the chamber to achieve impacting movement to the barrel contents, and additional means for circulating cool air within the chamber to assist in uniform cooling of media and elements within the chamber, and wherein the tumbling barrel has openings therein sufficiently large to allow the circulation of cooled air within the interior of the chamber to the interior of the barrel but sufficently small to avoid loss of elastomeric elements or delfashing media contained within the barel.

3. An apparatus for deflashing of elastomeric elements comprising (a) a refrigeration chamber sized for receiving a tumbling barrel and means for mounting a tumbling barrel therein, said chamber having an access opening for providing access to a barrel located therein, having means for lowering the temperature of the interior of the chamber and having additional cool air circulation means within the interior of the chamber; and said barrel having aperture means providing access of the cooled atmosphere within the refrigeration chamber into the interior of the tumbling barrel; and (b) for imparting motion to a barrel mounted within the chamber to achieve impacting movement to elements within the barrel.

4. An apparatus for deflashing of elastomeric elements comprising:

(a) a tumbling barrel having a closable opening for introducing and withdrawal of elastomeric elements and deflashing media to the interior of the barrel;

(b) a refrigeration chamber sized for receiving the barrel therein, having an access opening for providing access to a barrel located therein, having means for mounting the barrel therein, and having means for lowering the temperature of the interior of the chamber and having additional air circulation means for circulating cool atmosphere within the chamber; and said barrel having aperture means providing access of the cooled atmosphere within the refrigeration chamber into the interior of the tumbling barrel; and (c) means for imparting motion to the barrel mounted within the chamber to achieve impacting movement to the barrel contents.

5. The apparatus of claim 1 wherein the access opening of the chamber is closable.

6. The apparatus of claim 1 which further comprises means for removably mounting the barrel within the chamber.

7. The apparatus of claim 1 wherein the drive means is exterior of the refrigeration chamber.

8. The apparatus of claim 1 wherein the cooling means comprises a compressed gas refrigeration mechanism.

9. The apparatus of claim 1 having means for rotatably mounting the barrel within the refrigeration chamber, and drive means for rotating the barrel mounted within the chamber.

10. The apparatus of claim 9 which further comprises an axial shaft attached to and extending from the barrel and support bearings, said shaft being rotatably secured and supported within said bearings.

11. The apparatus of claim 10 wherein the shaft extends exterior of the refrigeration chamber and the support bearings are located exterior of the refrigeration chamber.

12. The apparatus of claim 11 wherein the drive means comprises a circular gear mounted on the shaft, a motor and drive connecting means connecting the motor to said gear for imparting rotary motion thereto.

13. The apparatus of claim 9 wherein the drive means is located exterior of the refrigeration chamber.

14. The apparatus of claim 1 wherein the speed of rotation of the barrel can be controlled at a value between zero and about 200 rpm.

15. The apparatus of claim 1 or 6 wherein the refrigerating means is capable of maintaining the temperature within the chamber at a value from about $-32°$ to $-150°$ F. with a variation in said value of $\pm 10°$ F.

16. The apparatus of claim 1 wherein the refrigeration chamber is insulated.

17. The apparatus of claim 1 having means for vibrating the barrel to impart impacting movement to the contents of the barrel.

18. The apparatus of claim 17 wherein the vibrating means is capable of imparting a vibration rate of from about 800 to 2000 cycles per minute to the barrel.

19. The apparatus of claim 1 having means for rotatably mounting the barrel within the refrigeration chamber and drive means for reciprocatingly rotating the barrel through rotation cycles of less than 360 degrees to impart an impacting movement to the contents of the barrel.

20. The apparatus of claim 19 wherein the drive means is capable of imparting a reciprocal rotation rate of from about 50 to 300 cycles per minute to the barrel.

21. The apparatus of claim 2 which further comprises means for removably mounting a tumbling barrel within the chamber.

22. The apparatus of claim 2 wherein the chamber is insulated.

* * * * *